US010232394B2

(12) United States Patent
Thorez et al.

(10) Patent No.: US 10,232,394 B2
(45) Date of Patent: Mar. 19, 2019

(54) DEVICE FOR DISTRIBUTING A LIQUID PARTICULARLY A COSMETIC LIQUID

(71) Applicant: ALBEA SERVICES, Gennevilliers (FR)

(72) Inventors: Gael Thorez, Voisins le Bretonneux (FR); Laurent Pesqueux, Teloché (FR); Jean-Pierre Rousseau, Le Mans (FR); Quentin Maunoury, Parigné l'évêque (FR)

(73) Assignee: Albea Services, Gennevilliers (FR)

( * ) Notice: Subject to any disclaimer, the term of this patent is extended or adjusted under 35 U.S.C. 154(b) by 0 days.

(21) Appl. No.: 15/606,748

(22) Filed: May 26, 2017

(65) Prior Publication Data

US 2017/0341096 A1 Nov. 30, 2017

(30) Foreign Application Priority Data

May 26, 2016 (FR) ..... 16 54725

(51) Int. Cl.

| | |
|---|---|
| ***B05B 11/00*** | (2006.01) |
| ***A45D 34/02*** | (2006.01) |
| ***B65D 25/20*** | (2006.01) |
| *A45D 34/00* | (2006.01) |

(52) U.S. Cl.

CPC ..... *B05B 11/306* (2013.01); *A45D 34/02* (2013.01); *B05B 11/0032* (2013.01); *B05B 11/3053* (2013.01); *B65D 25/20* (2013.01); *A45D 2034/007* (2013.01); *A45D 2200/053* (2013.01); *A45D 2200/057* (2013.01)

(58) Field of Classification Search

CPC .... A45D 34/02; B05B 11/0027; B05B 11/306

USPC ..... 222/153.13, 153.14, 182, 402.11, 519, 222/522

See application file for complete search history.

(56) References Cited

U.S. PATENT DOCUMENTS 5,004,127 A * 4/1991 Morel ..... B05B 11/0027 222/505

5,499,747 A 3/1996 Quennessen (Continued)

FOREIGN PATENT DOCUMENTS

| | | |
|---|---|---|
| EP | 2893833 | 7/2015 |
| FR | 2777868 | 10/1999 |
| WO | WO2000/0066459 | 11/2000 |

*Primary Examiner* — Vishal Pancholi

(74) *Attorney, Agent, or Firm* — Steven M. Greenberg, Esq.; Shutts & Bowen LLP

(57) ABSTRACT

A device for distributing a liquid. The device includes a bottle including a reservoir designed to store liquid, and a distribution element, and a concealment assembly. The distribution element allows the liquid to be distributed from the inside to the outside of the reservoir. The concealment assembly includes a base and a concealment ring that is movable along a main displacement axis from a first, operating position, to a second, locking position. The displacement of the concealment ring occurs through a helical movement of the concealment ring relative to the base in relation to the main displacement axis. As well, the displacement of the concealment ring from the operating position to the locking position allows at least part of the distribution element to be concealed. Finally, the concealment element further includes a ballast rigidly connected to the concealment ring.

11 Claims, 5 Drawing Sheets

(56) References Cited

U.S. PATENT DOCUMENTS

| | | | | |
|---|---|---|---|---|
| 7,874,465 | B2 * | 1/2011 | Bertin | B05B 11/0032 222/153.11 |
| 8,439,230 | B2 * | 5/2013 | Hagen | B05B 11/3001 222/153.13 |
| 8,695,852 | B2 * | 4/2014 | Bertin | B05B 11/0032 222/153.13 |
| 9,156,596 | B2 * | 10/2015 | Moreau | B05B 11/0029 |
| 2009/0071985 | A1 * | 3/2009 | Ki | B05B 11/0027 222/309 |
| 2009/0120963 | A1 * | 5/2009 | Bae | B05B 11/0032 222/153.13 |
| 2012/0024899 | A1 * | 2/2012 | Michaux | B05B 11/306 222/153.13 |
| 2015/0108171 | A1 * | 4/2015 | Kim | B05B 11/3001 222/321.3 |

* cited by examiner

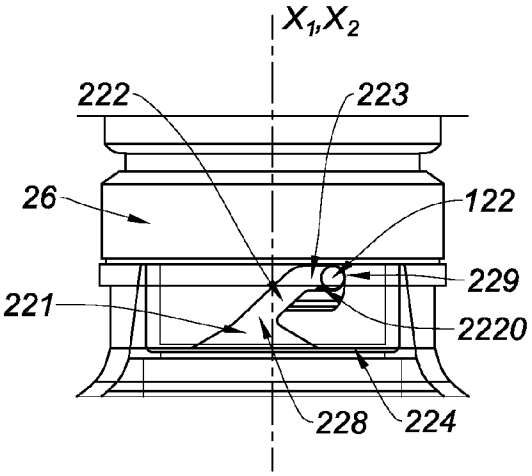
Fig. 3a
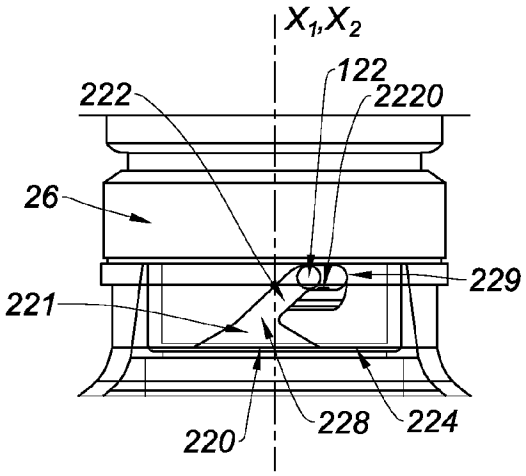
Fig. 3b
Fig. 3c

DEVICE FOR DISTRIBUTING A LIQUID PARTICULARLY A COSMETIC LIQUID

CROSS REFERENCE TO RELATED APPLICATIONS

This application claims priority under 35 U.S.C. § 119(a) to French Patent Application Serial Number 1654725, filed May 26, 2016, the entire teachings of which are incorporated herein by reference.

BACKGROUND OF THE INVENTION

Field of the Invention

The invention relates to a device for distributing a liquid, particularly a cosmetic liquid.

Description of the Related Art

Cosmetic liquid bottles conventionally include a reservoir for containing the cosmetic liquid and a distribution element designed to allow the cosmetic liquid to be distributed from inside the reservoir.

To prevent accidental distribution of the cosmetic liquid, it is known for these bottles to be fitted with a protective device that is designed to allow the distribution element to be rendered inoperative or inaccessible. For example, the protective device can include a movable part that moves between a first position, which allows the distribution element to be used, and a second position, which prevents its use.

This type of bottle does not currently give the impression of sophistication and luxury that users can legitimately expect. Therefore, there is a need for improvement.

BRIEF SUMMARY OF THE INVENTION

The present disclosure proposes a device for distributing a liquid. The device includes a bottle and a concealment assembly. The bottle includes a reservoir and a distribution element designed to allow the liquid to be distributed from the inside to the outside of the reservoir. The reservoir in turn is designed to store the liquid.

The concealment assembly includes a base and a concealment ring that is designed to be moved along a main displacement axis from a first position, referred to as the operating position, to a second position, referred to as the locking position. The movement of the concealment ring occurs through a helical movement of the concealment ring relative to the base in relation to the main displacement axis. The displacement of the concealment ring from the operating position to the locking position allows at least part of the distribution element to be concealed.

The concealment assembly further includes a ballast rigidly connected to the concealment ring. The presence of a ballast rigidly connected to the concealment ring increases the inertia thereof. This inertia helps to give the distribution device an impression of quality and handling comfort, making it particularly pleasant to use.

Various other aspects of the invention, which can be taken in combination or separately, are described herein as follows:

- The ballast and the concealment ring are two parts distinct from each other;
- The ballast and the concealment ring are two parts rigidly connected together;

- The concealment ring includes at least one first mechanical means, referred to as position retention means, designed to allow the ballast to be held in position relative to the concealment ring;
- The concealment ring includes at least one second mechanical means, referred to as positioning means, designed to allow the ballast to be positioned relative to the concealment ring;
- The positioning means is a locating element in the form of a lug integral with the concealment ring, the lug being intended to cooperate with a recessed part provided on a periphery of the ballast;
- The position retention means are projections;
- The ballast is provided with at least one hole;
- The ballast hole is intended to mechanically cooperate with the second mechanical means of the concealment ring in order to allow the ballast to be held in position;
- The ballast is designed to be arranged in an inner space of the concealment ring;
- The ballast and the concealment ring are rigidly connected to each other using a hot melting method;
- One out of the base and the concealment ring includes a protuberance, the other out of the base and the concealment ring includes a guide, the protuberance and the guide being designed to cooperate with each other so as to allow the concealment ring to move relative to the base from the locking position to the operating position;
- The concealment ring includes an outer part and an intermediate part rigidly connected together, the intermediate part being designed so as to mechanically cooperate with the base of the concealment assembly, the outer part being designed to be handled by a user;
- The inner ring and the outer ring are made from different materials;
- The ballast is in the form of a ring;
- The ballast is arranged orthogonal to the main displacement axis;
- The ballast and the distribution device are made from materials distinct from each other;
- The device further includes a protective part, the protective part and the bottle being intended to be fitted together in a detachable manner, the protective part comprising a protective jacket intended to cover at least part of the reservoir of the bottle;
- The bottle is attached to the protective part through a rotary movement of the bottle relative to the protective part about the main displacement axis;
- The rotary movement allows the protective part to be attached to the bottle and the rotary movement allows the protective ring to transition from the locking position to the operating position in the same circumferential direction;
- The rotary movement allows the protective part to be attached to the bottle and the rotary movement allows the protective ring to transition from the locking position to the operating position in an opposite circumferential direction.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIGS. 3*a* to 3*c* are partial side views of an example of a distribution device according to the invention showing various steps of attaching the protective part and the bottle;

DETAILED DESCRIPTION OF THE INVENTION

The invention relates to a device for distributing a liquid, particularly a cosmetic liquid. The cosmetic liquid is a scented water or a body care liquid, for example.

Figure 1:
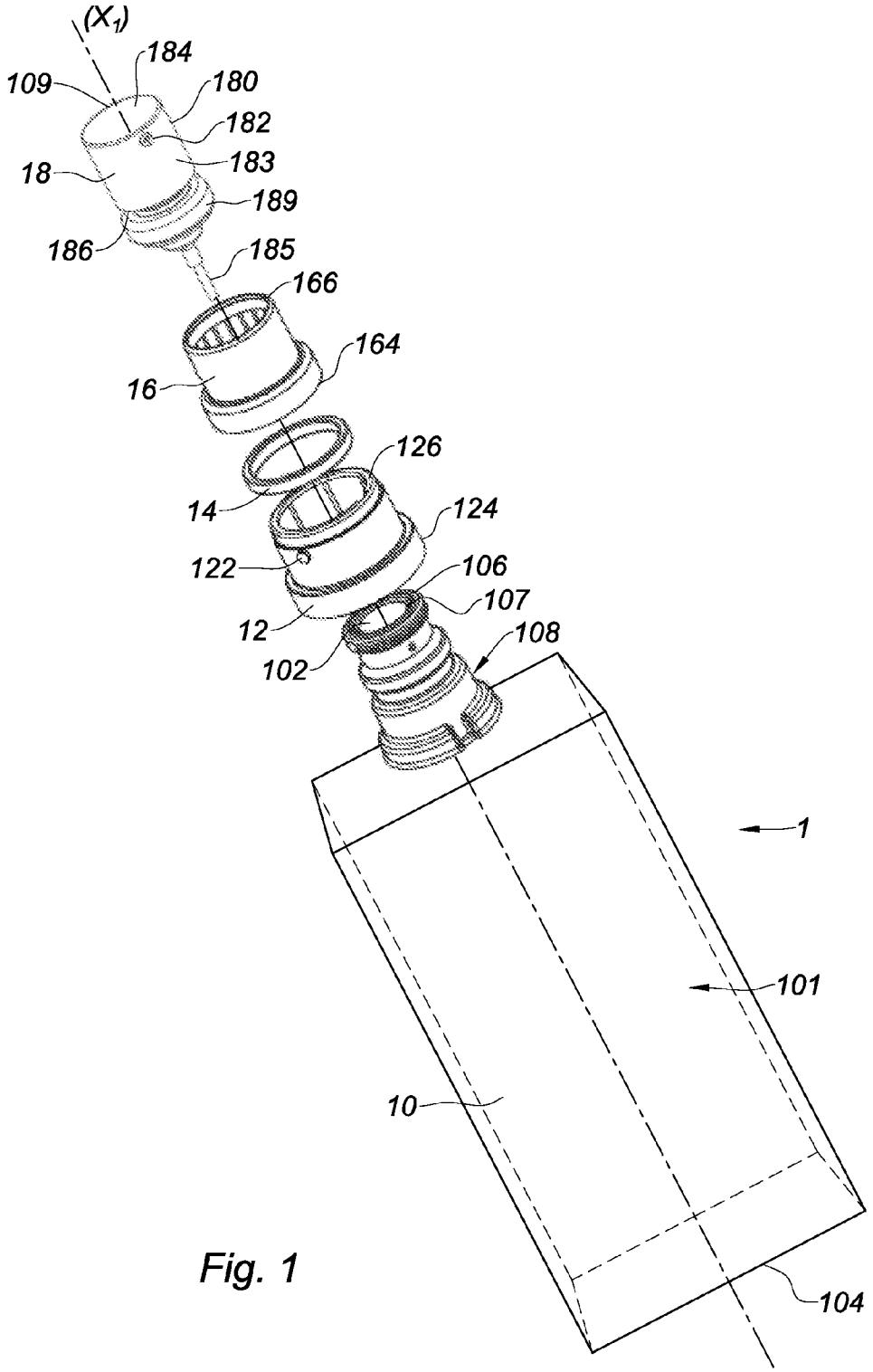
FIG. 1 is an exploded perspective view of an embodiment of a bottle according to the invention.
Figure 2:
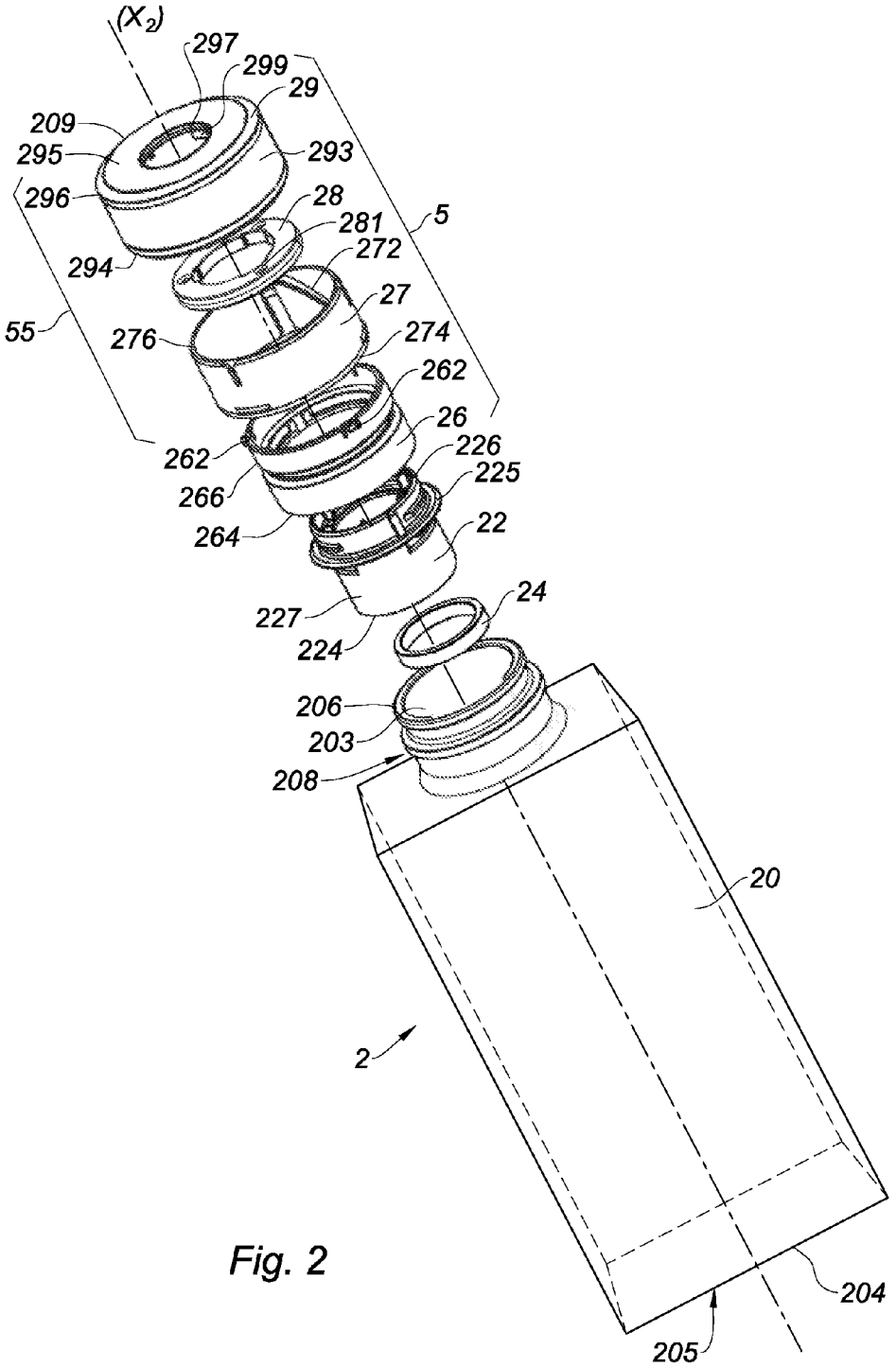
FIG. 2 is an exploded perspective view of an embodiment of a protective part according to the invention.
Figure 4:
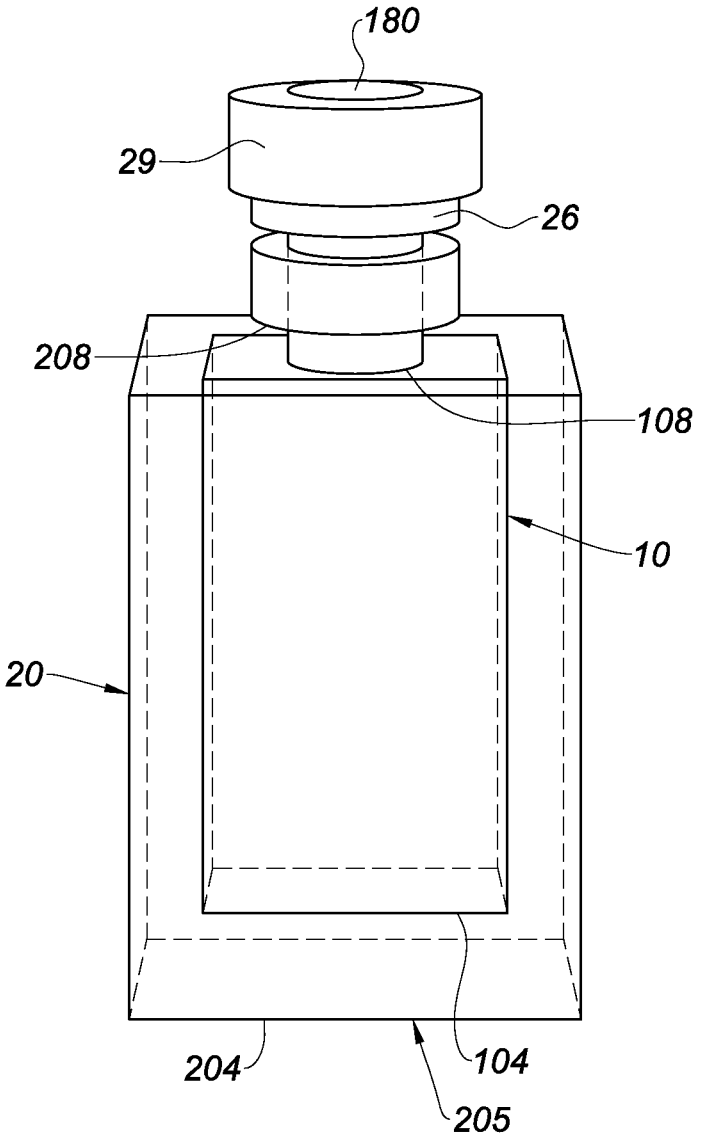
FIG. 4 is a perspective view of the distribution device according to the invention, in which the bottle and the protective part are attached together, the concealment ring being in the locking position.

As shown in FIGS. 1, 2 and 4, the distribution device includes a bottle 1 and a protective part 2. The bottle 1 is designed to receive and contain the cosmetic liquid. The protective part 2 is designed to surround the bottle 1 so as to particularly protect it by at least partly covering it. The protective part 2 and the bottle 1 are designed to be attached and/or fitted together by a user in a detachable manner.

As is particularly shown in FIG. 1, the bottle 1 includes a reservoir section, called reservoir 10, intended to contain and store the cosmetic liquid. The bottle 1 further includes a positioning part 16, a magnet 14 and a connection ring 12.

In this case, the bottle 1 is advantageously provided with a distribution element 18. The bottle 1 thus can be used independently of the rest of the distribution device. In particular, the user can use the bottle 1 independently of the protective part 2. Furthermore, the distribution device is designed so that the bottle 1 and the protective part 2 can be attached together without having to dismantle all or part of the bottle 1.

In this case, and as will be described more specifically hereafter, the reservoir 10, the positioning part 16, the magnet 14, the connection ring 12 and the distribution element 18 are attached together and are integral with each other.

The bottle 1 includes a lower end 104 and an upper end 109 and extends longitudinally in a main direction of longitudinal extension $X_1$, from the lower end 104 to the upper end 109. In particular, the bottle 1 extends longitudinally from a base of the reservoir 10 to a top end of the distribution element 18.

In this case, the reservoir 10 is of parallelepiped and extended shape on at least part of its length. It defines an inner space of the bottle 1. The reservoir 10 includes a lower end 104, corresponding to the base of the reservoir 10, and an upper end 106. The reservoir 10 extends from the lower end 104 to the upper end 106 in a main axial direction.

The main axial direction of the reservoir 10 in this case coincides with the main direction of longitudinal extension of the bottle 1. Furthermore, the lower end 104 of the reservoir 10 in this case coincides with the lower end 104 of the bottle 1.

The reservoir 10 has an inner surface 102 designed to be in contact with the cosmetic liquid and an outer surface 101 facing the outside of the reservoir 10.

In this case, the reservoir 10 is provided with a neck 108 in the vicinity of its upper end 106. In other words, the reservoir 10 terminates with a constriction at its upper end 106. Still in other words, the reservoir 10 has, in the vicinity of its upper end 106, a portion 108, the width of which, measured perpendicular to the main axial direction of the reservoir 10, is less than the remainder of the reservoir 10, the portion 108 being located in the vicinity of the upper end 106.

In this case, the reservoir 10 has a transverse section of circular or substantially circular shape in the vicinity of its neck 108, the transverse section being perpendicular to the main axial direction of the reservoir 10. In this case, the reservoir 10 has a transverse section of substantially square or rectangular shape over the remainder of its length.

The reservoir 10 includes a distribution hole 107. In this case, the distribution hole 107 is arranged in the vicinity of the upper end 106 of the reservoir 10. In other words, the distribution hole 107 is located at a free end of the neck 108 of the reservoir 10.

In this case, the reservoir 10 is transparent. For example, it is made from glass or plastic.

In this case, the distribution element 18 is a pump. It is designed to allow the liquid to be distributed from the inside of the reservoir 10 to the outside of the reservoir 10. The pump 18 in this case is arranged in the vicinity of the distribution hole 107 of the reservoir 10. In particular, the distribution element 18 is designed so that its activation by a user allows the liquid contained in the reservoir 10 to be distributed. In other words, the distribution element 18 is designed to allow the cosmetic liquid to be distributed from inside the reservoir 10 to outside the bottle 1.

The pump 18 in this case includes a base 189, a pushbutton 180 and a plunger tube 185. The plunger tube 185 is designed to be immersed in the cosmetic liquid contained in the reservoir 10. It allows the cosmetic liquid to be sucked so that it can be sprayed outwards through a spray hole 182.

A translation movement of the pushbutton 180 in a direction, called activation direction, relative to the base 189 allows the pump 18 to be activated by the user.

In this case, the pushbutton 180 is substantially in the shape of a solid cylinder. The pushbutton 180 includes a lower end 186 and an upper end 109 and extends in a main axial direction from one end to the other. The axial direction of the pushbutton in this case coincides with the activation direction. The pushbutton 180 in this case includes a lateral surface 183 that extends parallel to the main axial direction from the upper end 109 of the pushbutton 180 to its lower end 186. The pushbutton 180 is provided with a contact surface 184 on its upper end 109 that is designed to allow the triggering or activation of the distribution element 18 and the distribution of the cosmetic liquid. The contact surface 184 in this case extends orthogonal to the main axial direction of the pushbutton 180.

The main axial direction of the pushbutton 180 in this case coincides with the main direction of longitudinal extension of the bottle 1.

The upper end 109 of the pushbutton 180 in this case coincides with an upper end of the pump 18 and with the upper end 109 of the bottle 1.

The connection ring 12 is designed to cooperate with the protective part 2. The connection ring 12 in this case is a substantially cylindrical part. Specifically, the connection ring 12 is substantially in the form of a hollow cylinder or ring. It is arranged on the neck 108 of the reservoir 10 in the vicinity of the upper end 106.

The connection ring 12 in this case includes a lower end 124 and an upper end 126 and extends in a main axial direction between the lower end 124 and the upper end 126. The main axial direction of the ring 12 in this case coincides with the main direction of longitudinal extension of the bottle 1.

The connection ring 12 includes an inner surface intended to cooperate with the neck 108 of the reservoir 10 and an outer surface intended to cooperate with the protective part 2. Each of the outer and inner surfaces axially extend from one end of the connection ring 12 to the other.

The connection ring 12 further includes a protuberance 122. The protuberance 122 in this case projects from the outer surface of the connection ring 12. For example, the protuberance 122 is a substantially cylindrical pin.

In this case, the connection ring 12 is screwed onto the reservoir 10. To this end, the neck 108 of the reservoir 10 in this case is threaded in the vicinity of the outer surface 101 of the reservoir 10. Furthermore, a tapping on the inner surface of the connection ring 12 allows the connection ring 12 to be screwed onto the reservoir 10. Therefore, the connection ring 12 is rigidly connected to the reservoir 10. By way of a variant, the reservoir 10 and the connection ring 12 can be rigidly connected together by clipping, bonding, force fitting, for example, without this departing from the scope of the invention.

The positioning part 16 is a substantially cylindrical part. It includes a lower end 164 and an upper end 166 and extends in a main axial direction between the lower end 164 and the upper end 166. The main axial direction of the positioning part 16 in this case coincides with the main direction of longitudinal extension of the bottle 1.

In this case, the positioning part 16 is arranged so that its lower end 164 is located in the vicinity of the upper end 126 of the connection ring 12. In other words, the positioning part 16 is designed to be arranged above the connection ring 12, between the upper end 109 of the bottle 1 and the upper end 126 of the connection ring 12. In particular, the positioning part 16 is arranged relative to the connection ring 12 so as to allow an annular magnet 14 to be held between the positioning part 16 and the connection ring 12.

The pump 18 is arranged in the bottle so as to be partly surrounded by the positioning part 16. When the pump 18 is activated, the pushbutton 180 penetrates the positioning part 16 such that the positioning part 16 then hides part of the lateral surface of the pushbutton 180. The positioning part 16 particularly acts as an axial guide for the pump 18.

As is particularly shown in FIG. 2, the protective part 2 extends longitudinally in a main direction of longitudinal extension $X_2$ between an upper end and a lower end.

In this case, the protective part 2 includes a part, called protective jacket 20, that is designed to protect the bottle 1. The protective jacket 20 in this case defines an inner space of the protective part 2. Advantageously, the protective jacket 20 is rigid, which contributes to the protective function, for example. It is made from a transparent material in this case. It can be made from glass or plastic, in particular.

In particular, the protective jacket 20 in this case is designed so that the user can see the reservoir 10 of the bottle 1 through the protective jacket 20.

In this case, the protective jacket 20 has a substantially parallelepiped and extended shape on at least part of its length. It has a lower end 204 and an upper end 206. The protective jacket 20 in this case extends in a main axial direction from the lower end 204 to the upper end 206. The main axial direction of the protective jacket 20 in this case coincides with the main direction of longitudinal extension of the protective part 2.

In this case, the lower end of the protective jacket 20 corresponds to a lower end 204 of the protective part 2, as well as to a lower end of the distribution device when the protective part 2 and the bottle 1 are fitted together.

As is particularly shown in FIG. 4, it will be noted that when the bottle 1 and the protective part 2 are attached together, their main directions of longitudinal extension $X_1$ and $X_2$ coincide with a direction, called attachment direction, for attaching the bottle 1 to the protective part 2.

The protective jacket 20 is designed so that, once attached to the bottle 1, the lower end 104 of the bottle 1 is arranged between the lower end 204 and the upper end 206 of the protective jacket 20 in the direction of extension of the attachment direction.

In other words, the distribution device is designed so that, once the bottle 1 and the protective part 2 are attached together, the lower end 104 of the reservoir 10 does not exceed the protective jacket 20. In other words, the bottle 1 does not exceed the protective part 2 in the vicinity of the lower end 204 of the protective jacket 20.

The lower end 204 of the protective jacket 20 is designed so as to allow the distribution device to rest on a flat surface, particularly a table, the edge of a sink or a shelf, the lower end 204 being in contact with the flat surface. In this way, the protective part 2 fulfils a function both of protecting the bottle 1 and of supporting the distribution device.

By way of a variant, the distribution device can be designed so that, once the bottle 1 and the protective part 2 are attached together, the lower end 104 of the reservoir 10 exceeds the protective jacket 20. The lower end 104 of the reservoir 10 can then be flat, with the lower end 104 acting as a support for the distribution device.

The protective jacket 20 is open at its lower end 204 so as to allow the bottle 1 to transition from outside the protective part 2 to inside the protective part 2. In other words, the protective jacket 20 includes, at its lower end 204, an opening 205 or a hole, in this case an opening, that is designed to allow the through passage of the bottle 1.

In this case, an outline of the opening 205 is substantially included in a plane orthogonal to the attachment direction.

The upper end 206 of the protective jacket 20 corresponds to a connection zone of the protective part 2.

In particular, the protective jacket 20 in this case is provided with a neck 208 in the vicinity of its upper end 206. In other words, the protective jacket 20 terminates with a constriction in the vicinity of its upper end 206. In other words, the protective jacket 20 has a portion 208 in the vicinity of its upper end 206, the width of the portion, measured perpendicular to the main direction of extension of the protective jacket 20, being less than the rest of the protective jacket 20, the portion 208 being arranged in the vicinity of the upper end 206 of the protective jacket 20.

In this case, the protective jacket 20 has a transverse section of substantially circular shape in the vicinity of its neck 208, the transverse section being perpendicular to the main axial direction of the protective jacket 20. The protective jacket 20 in this case has a transverse section of substantially square or rectangular shape over the remainder of its length, outside the neck 208.

The distribution device includes at least one attachment device designed to allow the bottle 1 and the protective part 2 to be attached together in the attachment direction.

In particular, in this case the attachment device includes a protuberance 122 and a guide element 22. The protuberance 122 and the guide element 22 are intended to cooperate with each other in order to allow the bottle 1 and the protective part 2 to be attached together.

In this case, the bottle 1 is provided with the protuberance 122. The protective part is provided with the guide element 22. By way of a variant, the bottle 1 can be provided with the guide element 22 and the protective part 2 can be provided with the protuberance 122, for example.

In this case, the guide element 22 is designed to be arranged in the vicinity of the upper end 206 of the protective jacket 20, in other words in the vicinity of the connection zone of the protective part 2. In particular, the guide element 22 in this case is arranged at least partially inside the neck 208 of the protective jacket 20.

For example, the guide element 22 is a part in the form of a hollow cylinder or ring. It extends in a main axial direction that coincides with the main direction of longitudinal extension of the protective part, between a lower end and an upper end.

For example, the guide element 22 is made from plastic material. Advantageously, the guide element 22 is placed inside the neck 208, to which it is adhered, for example.

The guide element 22 in this case includes a shoulder or annular plate 225 and a lateral wall 227.

The lateral wall 227 has a lower end 224 and an upper end 226 that respectively coincide with the lower end and the upper end of the guide element.

The lateral wall 227 extends in a main axial direction from the lower end 224 to the upper end 226, the main axial direction of the lateral wall 227 coinciding with that of the guide element 22.

The lateral wall 227 of the guide element 22 in this case includes an outer surface facing the outside of the guide element 22 and an inner surface facing the inside of the guide element 22. In other words, the inner surface defines an inner space of the guide element 22. Each of the surfaces extend from one end of the guide element 22 to the other, parallel to each other.

The shoulder 225 is designed so as to encircle the lateral wall 227 and is rigidly connected thereto. In particular, the shoulder 225 projects radially from the outer surface of the lateral wall 227. The shoulder 225 in this case includes a lower surface and an upper surface, both extending orthogonal to the main axial direction of the guide element 22.

The shoulder 225 is designed to allow the guide element 22 to be arranged on the upper end 206 of the protective jacket 20. In this case in particular, the annular plate 225 is designed so that the lower surface of the shoulder is in contact with and comes into abutment against the free end of the neck 108 of the protective jacket 20.

As is particularly shown in FIGS. 3*a* to 3*c*, the guide element 22 is designed to mechanically cooperate with the connection ring 12. In particular, the guide element 22 is designed to mechanically cooperate with the protuberance 122 of the connection ring 12. In other words, the protuberance 122 of the connection ring 12 of the bottle 1 is designed to mechanically cooperate with the guide 222 of the guide element 22 of the protective part 2. To this end, the lateral wall 227 of the guide element 22 is provided with a guide 222.

The guide 222 in this case is a longitudinal hole passing through either side of the lateral wall 227 of the guide element 22. By way of a variant, the guide 222 can be a recess or a slot, for example, produced on the inner surface of the lateral wall 227.

The guide 22 includes a stop end 229 and an inlet end 220 and extends longitudinally along a guide path, which is not necessarily straight, from the inlet end 220 to the stop end 229.

The inlet end 220 of the guide 222 in this case is located at the lower end 224 of the guide element 222. The inlet end 220 of the guide 222 is designed to allow the protuberance 122 of the bottle 1 to engage with the guide 222 of the protective part 2. The stop end 229 of the guide 222 corresponds to the end of the guide path of the guide 222, so that the protuberance can cooperate with the guide 222 by moving from the inlet end 220 to the stop end 229.

In other words, the protuberance 122 and the guide 222 are respectively designed as a cam and a cam path.

A dimension of the guide 222, called width, is measured perpendicular to its direction of longitudinal extension. The width of the guide 222 over most of its length is at least equal, with a close clearance, to a larger transverse dimension of the protuberance 122.

In particular, the guide 222 includes a portion 221, called flared portion, in the vicinity of its inlet end 220. In particular, the flared portion 221 of the guide 222 is such that the width of the guide 222 increases as the inlet end 220 is approached.

The flared portion 221 facilitates the introduction of the protuberance 122 into the guide 222. In other words, the flared portion 221 facilitates the engagement of the protuberance 122 inside the guide 222 and thus facilitates the fitting together and/or attaching together of the bottle 1 and the protective part 2.

The guide 222 in this case includes a first section 228, called inlet path, and a second section 223, called locking path. The inlet path 228 and the locking path 223 follow one behind the other along the guide between the inlet end 220 and the stop end 229. In other words, the guide 222 is designed so that the protuberance 122 can move by mechanically cooperating with the inlet path 228 and then the guide path 223 in succession.

The inlet path 228 extends obliquely relative to the main axial direction of the lateral wall 227 of the guide element 222. The locking path 223 in turn extends substantially orthogonal to the main axial direction of the lateral wall 227.

When the protuberance 122 cooperates with the locking path 223, the orientation of the locking path 223 relative to the direction of extension of the lateral wall 227, and therefore relative to the attachment direction, allows any translation movement of the protuberance 122 relative to the guide element 22 to be locked in the direction of extension of the protective part 2.

In other words, the locking path 223 of the guide 222 is designed so that, when the protuberance 122 is inside the locking path 223, then the bottle 1 and the protective part 2 are translationally locked relative to each other in the attachment direction. Still in other words, when the protuberance 122 is located inside the locking path 223, the protective part 2 and the bottle 1 are translationally locked one relative to the other in a direction for fitting the bottle 1 inside the protective part 2.

The locking path 223 of the guide 222 is provided with a constriction zone 2220, in the vicinity of which the width of the guide 22 is slightly less than the rest of the guide 22. The constriction zone 2220 is arranged at a distance from the stop end of the guide. In particular, the constriction zone 2220 is arranged along the guide 222 between the stop end 229 and the inlet path 228.

The constriction zone 2220 is designed to provide mechanical resistance for the passage of the protuberance 122. The width of the guide 220 in the vicinity of the constriction zone 2220 is slightly less than the largest transverse direction of the protuberance 122, for example.

Advantageously, the protuberance 122 passes through the constriction zone 2220 of the guide 222 by elastic deformation. This elastic deformation allows the user to feel when the protuberance 122 enters the guide 222 in the vicinity of the constriction zone 2220.

In addition to this notification function, the constriction zone 2220 is also mechanically opposed so that the protuberance 122 does not unexpectedly or accidentally depart from the stop end 229. In other words, the constriction zone 2220 allows the locking together of the bottle 1 and of the protective part 2 to be secured.

Outside the flared portion 221 and the constriction zone 2220, the width of the guide 222 is substantially equal, with a close clearance, to the largest transverse dimension of the protuberance 122.

FIGS. 3*a* to 3*c* show various steps of the attaching together of the bottle 1 and the protective part 2.

In FIG. 3*a*, the protuberance 122 is located at the inlet of the guide 222 in the vicinity of the flared portion 221.

In FIG. 3*b*, the protuberance is located in the vicinity of a junction between the locking portion 223 and an inlet path 228. Specifically, the protuberance 122 is located between the constriction zone 2220 and the junction between the locking path 223 and the inlet path 228.

In FIG. 3*c*, the protuberance 122 is located in a position, called stop position, between the stop end 229 and the constriction zone 2220. As previously mentioned, when the protuberance 122 is located thus, the bottle 1 and the protective part 2 are translationally locked one relative to the other in the attachment direction.

As shown in FIG. 2, the protective part 2 includes a magnet 24, for example. The magnet 24 is designed to draw the bottle 1 towards the protective part 2 so that the protuberance 122 reaches the locking path 223 of the guide element 22. In other words, the magnet 24 helps to position the bottle 1 relative to the protective part 2 when they are attached together. The magnet 24 is designed to be arranged in the vicinity of the upper end 206 of the protective jacket 20. In particular, the magnet 24 is arranged in the vicinity of the upper end of the guide element 22, for example.

The distribution device is designed so that the bottle 1 can be inserted inside the protective part 2 through the opening 205 of the protective jacket 20. Specifically, when the user wants to attach the protective part 2 to the bottle 1, the user brings the connection ring 12 of the bottle 1 into contact with the lower end 224 of the guide element 22 of the protective part 2. Still more specifically, the user brings the protuberance 122 of the connection ring 12 into the vicinity of the lower end 224 of the guide element 22.

The attachment is then completed by particularly bringing the protuberance 122 into the vicinity of the inlet end 220 of the guide 222 of the guide element 22. The flared portion 221 of the guide 222 in the vicinity of the inlet end 220 is designed to allow the user to easily position the bottle 1 and the protective part 2 relative to each other with a view to their attachment.

In particular, the presence of the flared portion 221 means that it is easy to make the protuberance 122 cooperate with the guide 222 by asserting a rotary movement on the bottle 1 relative to the protective part 2. From this point, the protuberance 122 is able to move to the stop position 229 by passing through the inlet path 228, then through the locking part 223.

The bottle 1 and the protective part 2 are particularly attached by rotating one relative to the other about an axis of rotation that coincides with the attachment direction. The attachment device is then designed to convert the rotation into a translation movement in the attachment direction, so as to cause the bottle 1 and the protective part 2 to be attached together.

Advantageously, as shown in FIG. 1, the bottle 1 is further provided with a magnet 14. The magnet 14 of the bottle 1 in this case is designed and arranged so that the bottle 1 is drawn by the magnet 28 of the protective part 2 during attachment.

In this case in particular, the magnet 14 is arranged in the vicinity of the upper end 106 of the reservoir 10. Specifically, the magnet 14 of the bottle 1 in this case is arranged between the upper end 126 of the connection ring 12 and the protuberance 122.

The relative positioning of the magnets 14 and 24 allows reciprocal attraction and thus facilitates the attachment of the protective part 2 to the bottle 1.

Furthermore, the magnets 14 and 24 help to retain, in other words lock, the position of the bottle 1 and the protective part 2 relative to each other when they are attached together.

The protective jacket 20 is provided with an opening or a hole, in this case a hole 203 in the vicinity of its upper end 206. In particular, the hole 203 is located in the vicinity of the free end of the neck 208 of the protective jacket 20.

The hole 203 of the protective jacket 20 is designed so that the pump 18 of the bottle 1 can be accessed by the user through the protective part 2. In this case in particular, the hole 203 allows the pushbutton 180 of the bottle 1, or at least part of the pushbutton 180, to pass through the hole 203. The pushbutton 180 is then advantageously accessible to a user intending to wear the cosmetic product contained in the bottle 1.

The dimensions of the protective jacket 20 and the reservoir 10 are provided so that the reservoir 10 can undergo a rotation, relative to the protective jacket 20, about the main axial direction of the bottle 1 when the bottle 1 is attached, or is about to be attached, to the inside of the protective part 2.

Figure 5:
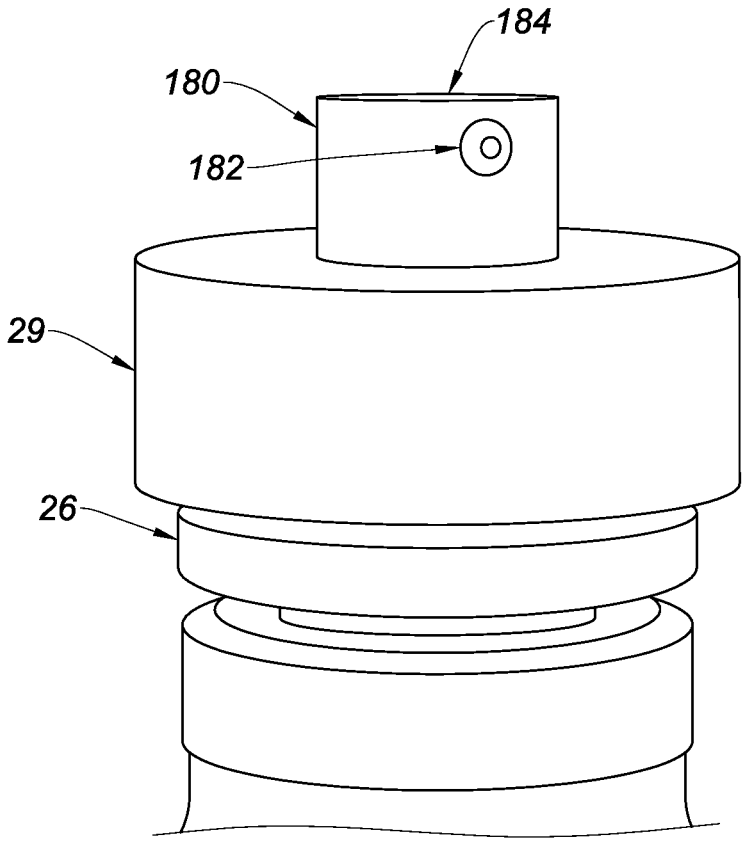
FIG. 5 is a perspective view of part of the distribution device according to the invention when the concealment ring is in the operating position.

As is particularly shown in FIGS. 2, 4 and 5, the distribution device includes a concealment assembly 5. The concealment assembly 5 in this case includes a fixed part, called base 26, and a movable part 55. The movable part 55 particularly includes a concealment ring.

The concealment ring is designed to be moved by the user, relative to the base 26, along a main displacement axis from a first position, called operating position, to a second position, called locking position. In other words, the concealment ring is designed to move between the operating position and the locking position, from one to the other.

In this case, moving the concealment ring from the operating position to the locking position allows at least part of the distribution element 18 to be concealed. Conversely, moving the concealment ring from the locking position to the operating position allows at least part of the distribution element 18 to be revealed. In other words, moving the concealment ring between the locking position and the operating position allows, according to the direction of movement of the concealment ring, at least part of the pushbutton 180 to be revealed or concealed.

In this case, the concealment ring allows, when it is in the locking position, the whole of the pushbutton 180 to be surrounded.

Moving the concealment ring from the operating position to the locking position allows the distribution element 18 to be less easily accessible to the user, so as to prevent accidental activation or triggering of the distribution element 18.

Furthermore, the concealment assembly 5 can also fulfil an aesthetic function, for example by allowing the distribution hole 182 of the pushbutton 180 to be hidden when the bottle 1 is not used or is about to be used.

The main displacement axis along which the concealment ring moves in this case coincides with the direction of activation of the pushbutton 180. Furthermore, the main displacement axis in this case further coincides with the attachment direction of the bottle 1 and the protective part 2, one relative to the other. As will be described hereafter, this feature allows the use of the distribution device to be simplified.

The displacement of the concealment ring in this case occurs through a helical or substantially helical movement of the concealment ring relative to the base 26. The helical movement occurs about the main displacement axis.

In this case, the movable part 55 of the concealment assembly 5 further includes a ballast 28.

The ballast 28 and the concealment ring in this case are elements that are distinct from each other. However, they are rigidly connected together. In other words, the ballast 28 and the concealment ring are designed to be flush mounted, one relative to the other. As will be described hereafter, the ballast 28 is designed to be arranged in an inner space of the concealment ring.

In this case, the concealment ring is made up of two distinct parts. In particular, in this case it includes an activation wheel 29 and a wheel support 27. The activation wheel 29 is designed to be handled by the user so as to allow the concealment ring to move from its locking position to the operating position. The wheel support 27 is in turn designed to mechanically cooperate with the base 26. The activation wheel 29 and the wheel support 27 in this case are rigidly connected together. For example, they are force fitted into each other, particularly by clipping. In this case in particular, the wheel support 27 is designed to be force fitted inside the activation wheel 29.

In this case, the base 26 is rigidly connected to the protective jacket 20 of the protective part 2. Furthermore, when the bottle 1 and the protective part 2 are attached together, the base 26 is designed so that it is also rigidly connected to the reservoir 10 of the bottle 1.

The base 26 is substantially in the form of a hollow cylinder or ring. It includes a lower end 264 and an upper end 266, and extends from one to the other in a main axial direction of the base 26. The main axial direction of the base 26 in this case coincides with the main displacement axis and the activation direction of the pushbutton 180. The base 26 has an inner surface and an outer surface that extend parallel to each other from the lower end 264 of the base 26 to its upper end 266.

One out of the base 26 and the wheel support 27 includes at least one protuberance 262, for example, while the other out of the base 26 and the concealment ring includes at least one guide 272. The protuberance 262 and the guide 272 are designed to cooperate with each other so as to allow the concealment ring to move relative to the base 26, from the locking position to the operating position.

In the embodiment described herein, it is the base 26 that is provided with the at least one protuberance 262, in this case three protuberances 262, intended to cooperate with the wheel support 27.

In this case, the protuberances 262 project from the outer surface of the base 26 and are angularly distributed in an even manner about the main axial direction of the base 26. The protuberances 262 in this case are arranged in the vicinity of the upper end 266 of the base 26. As previously mentioned, the wheel support 27 is designed to mechanically cooperate with the base 26. In particular, the wheel support 27 is provided with the at least one guide 272, in this case three guides 272, intended to each mechanically cooperate with one of the protuberances 262 of the base 26.

The wheel support 27 is substantially in the form of a hollow cylinder or ring. It includes a lower end 274 and an upper end 276 and extends from one to the other in a main axial direction of the wheel support 27. The main axial direction of the wheel support 27 in this case coincides with the main direction of longitudinal extension of the protective part 2.

In this case, the wheel support 27 has an inner surface and an outer surface, which extend parallel to each other from the lower end 274 of the wheel support 27 to the upper end 276 of the wheel support 27.

Each of the guides 272 of the wheel support 27 in this case is a recess disposed on the inner surface of the wheel support 27. By way of a variant, the guides 272 of the wheel support 27 can be holes radially passing through either side of the wheel support 27.

In this case, each of the guides 272 extends obliquely relative to the main direction of extension of the wheel support 27, between the lower end 274 and the upper end 276.

In particular, the guides 272 are designed to allow a rotary movement of the wheel support 27 relative to the base 26 to be converted into a translation movement along the main displacement axis.

The wheel support 27 in this case is able to rotationally and translationally move relative to the base 26, the wheel support 27 and the base 26 being coaxial.

In this case, the activation wheel 29 assumes the form of a cylindrical shaped cap that extends axially in a main axial direction of the activation wheel. The main axial direction of the activation wheel 29 in this case coincides with the main displacement axis.

The activation wheel 29 particularly has an upper end 296 and a lower end 294 and extends in its main axial direction from one end to the other.

In particular, the activation wheel 29 includes a plate 295, corresponding to the upper end 296 of the activation wheel 29, and a lateral wall 293 that extends from a periphery of the plate 295, orthogonal thereto. Specifically, the lateral wall 293 extends between the plate 295 and the lower end 294 of the activation wheel 29. It delimits, with the plate 295, an inner space of the activation wheel 29.

The plate 295 of the activation wheel 29 in this case is provided with a through hole 297 at its centre that is intended to allow the passage of the pushbutton 180 of the distribution element 18 when the concealment ring moves between the operating and locking positions.

The ballast 28 shown in FIG. 2 is designed in order to substantially increase the mass and the inertia of the concealment ring in order to enhance the sensations of the user. The presence of the ballast 28 thus enhances the perception of quality exuded by the distribution device. Advantageously, the ballast 28 is made from a material different from that of the operating wheel 29 or the support wheel 27. The ballast 28 is made from a material having a particularly high density, particularly a metallic material, for example.

In this case, the ballast 28 has a substantially annular shape. It is designed to be arranged so that it is orthogonal to the main displacement axis. In particular, the ballast 28 is designed to be arranged in the vicinity of the upper end of the activation wheel, for example in contact with the plate 295.

The ballast 28 and the activation wheel 29 are designed to be rigidly connected together. In particular, the ballast 28 is designed to be arranged in an inner space of the activation wheel 29.

To this end, the activation wheel 29 in this case is provided with first mechanical means, called position retention means, and at least one second mechanical means, called positioning means. The position retention means and the positioning means are designed to allow and/or facilitate the rigid connection of the ballast 28 to the activation wheel 29.

In particular, the position retention means are designed to allow the ballast 28 to be held in position in the inner space of the activation wheel 29. In this case, they are formed by three projections 281, not shown in the figures, which are integral with the plate 295 of the activation wheel 29. The projections are designed to mechanically cooperate with the ballast 28.

To this end, the ballast 28 is provided with at least one hole 281, called retention hole, in this case three retention holes 281, designed to mechanically cooperate with each of the projections of the activation wheel 29.

The positioning means of the activation wheel 29 is a locating element in this case. The locating element is in the form of a mechanical lug 299 projecting from an inner periphery of the plate 295 of the activation wheel 29, in the vicinity of the through hole 297. The mechanical lug 299 in this case projects substantially orthogonal to the plate 295. It is designed to mechanically cooperate with the ballast 28.

To this end, the ballast 28 includes a recess or recessed section realised in the vicinity of an inner periphery of the ballast 28. When the ballast 28 is attached to the activation wheel 29, the recess of the ballast 28 is designed to mechanically cooperate with the mechanical lug 299 of the activation wheel 29.

Advantageously, the ballast 28 is attached inside the activation wheel 29 by positioning the recess of the ballast 28 in the vicinity of the mechanical lug 299 of the activation wheel 29. The ballast 28 is designed so that, once it is positioned thus, the projections of the activation wheel 29 then coincide with the retention holes 281 of the ballast 28. In other words, each of the projections of the activation wheel 29 mechanically cooperates with one of the holes 281 of the ballast 28.

Once the ballast 28 is thus positioned inside the activation wheel 29, the ballast 28 and the activation wheel 29 are then definitively rigidly connected together, for example by hot melting.

The wheel support 27 and the activation wheel 29 can be made from different materials.

In particular, the material used to make the activation wheel 29 can be selected so that it is particularly pleasant to the touch or even so as to allow sufficient adhesion when the concealment ring is handled by the user.

With respect to the wheel support 27, it is subject to physical constraints and forces due to the direct mechanical cooperation with the base 26. Consequently, a suitable and therefore particularly resistant material preferably can be used for the wheel support 27.

The concealment assembly, formed by the ballast 28 and the concealment ring, in this case has a lower end and an upper end respectively coinciding with the lower end 294 and the upper end 296 of the activation wheel 29.

It is to be noted that in this case the upper end 209 of the protective part 2 coincides with the upper end 296 of the activation wheel 29 and therefore with the upper end of the concealment ring.

The concealment ring, which is formed by the activation wheel 29 and the support wheel 27, is able to translationally move, in any direction, particularly relative to the protective jacket 20 in the main direction of longitudinal extension of the protective part 2.

When the concealment ring is in the locking position, as is particularly shown in FIG. 4, the pushbutton 180 is at least partially hidden by the activation wheel 29. In particular, the lateral surface 183 of the pushbutton 180 is hidden by the activation wheel 29 or is at least partly hidden. In this case in particular, in the locking position the upper end 109 of the pushbutton 180 is arranged in the vicinity of the plate 295 of the activation wheel 29.

Conversely, when the concealment ring is in the operating position, as shown in FIG. 5 in particular, the pushbutton 180 exceeds, in this case considerably exceeds, the concealment assembly. In particular, the contact surface 184 of the pushbutton 180 is located at a distance from the plate 295 of the activation wheel 29, which allows the pushbutton 180 to be handled by the user.

Furthermore, it is to be noted that the rotary movement allowing the protective part 2 to be attached to the bottle 1 and the rotary movement allowing the concealment ring to transition from the locking position to the operating position occur in the same circumferential direction, for example. For this reason, the user, holding the reservoir 10 of the bottle 1 in one hand and the concealment ring in the other hand, can, in one and the same single, simple and continuous rotary movement, attach the bottle 1 to the protective part 2, then reveal the pushbutton 180. Thus, at the end of this single movement, the bottle 1 and the protective part 2 are attached together and the distribution device is also ready to be used, the pushbutton being revealed. This configuration improves the experience of the user by simplifying the use of the distribution device.

By way of a variant, the rotary movement allowing the protective part 2 to be attached to the bottle 1 and the rotary movement allowing the concealment ring to transition from the locking position to the operating position occur in two opposite circumferential directions, for example. This configuration provides security when attaching the bottle and the protective part. It particularly prevents the user from accidentally moving the concealment ring relative to the base 26 when he only intends to attach or detach the bottle 1 and the protective part 2.

In this case, the concealment assembly forms part of the protective part 2. In other words, when the protective part 2 is detached from the bottle 1, the concealment assembly remains rigidly connected to the protective part 2.

By way of a variant, in an embodiment that is not shown, the concealment assembly can be directly mounted on the bottle 1. In this way, when the protective part 2 is detached from the bottle 1, this time the concealment assembly remains rigidly connected to the bottle 2. The concealment assembly mounted on the bottle 1 can then operate with or without the protective part 2 present.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

We claim:

1. A device for distributing a liquid, comprising:

a bottle and a concealment assembly, the bottle comprising a reservoir adapted to store liquid, and a distribution element allowing the liquid to be distributed from inside of the reservoir to outside of the reservoir, the concealment assembly comprising a base and a concealment ring, the concealment ring configured for movement along a main displacement axis from a first, operating position, to a second, locking position, and for displacement through a helical movement of the concealment ring relative to the base in relation to the main displacement axis, the displacement of the concealment ring from the operating position to the locking position allowing at least part of the distribution element to be concealed, the concealment assembly further comprising a ballast rigidly connected to the concealment ring, the ballast and the concealment ring being flush mounted, one relative to the other.

2. The device according to claim 1, wherein the ballast is arranged in an inner space of the concealment ring.

3. The device according to claim 1, wherein the base comprises a protuberance and the concealment ring comprises a guide, the protuberance and the guide cooperating with each other so as to allow the concealment ring to move relative to the base from the locking position to the operating position.

4. The device according to claim 1, wherein the concealment ring comprises a protuberance and the base comprises a guide, the protuberance and the guide cooperating with each other so as to allow the concealment ring to move relative to the base from the locking position to the operating position.

5. The device according to claim 1, wherein the concealment ring comprises an activation wheel adapted for handling by a user, and a wheel support rigidly connected to the activation wheel, the wheel support mechanically cooperating with the base of the concealment assembly.

6. The device according to claim 1, further comprising a protective part adapted for fitting with the bottle in a detachable manner, the protective part comprising a protective jacket covering at least part of the reservoir of the bottle, the bottle being attached to the protective part through a rotary movement of the bottle relative to the protective part, about the main displacement axis.

7. The device according to claim 6, wherein the rotary movement allowing the protective part to be attached to the bottle and the rotary movement allowing the concealment ring to transition from the locking position to the operating position occur in the same circumferential direction.

8. The device according to claim 6, wherein the rotary movement allowing the protective part to be attached to the bottle and the rotary movement allowing the concealment ring to transition from the locking position to the operating position occur in opposite circumferential directions.

9. A device for distributing a liquid, comprising:

a bottle and a concealment assembly, the bottle comprising a reservoir adapted to store liquid, and a distribution element allowing the liquid to be distributed from inside of the reservoir to outside of the reservoir, the concealment assembly comprising a base and a concealment ring, the concealment ring configured for movement along a main displacement axis from a first, operating position, to a second, locking position, and for displacement through a helical movement of the concealment ring relative to the base in relation to the main displacement axis, the displacement of the concealment ring from the operating position to the locking position allowing at least part of the distribution element to be concealed, the concealment assembly further comprising a ballast rigidly connected to the concealment ring, wherein the ballast and the concealment ring are two distinct parts rigidly connected together by a position retention means and by a positioning means.

10. The device according to claim 9, wherein the positioning means is a lug integral with the concealment ring, said lug cooperating with a recessed part provided on a periphery of the ballast.

11. The device according to claim 9, wherein the ballast is provided with a retention hole mechanically cooperating with the position retention means of the concealment ring in order to allow the ballast to be held in position.

* * * * *